US010443165B2

(12) United States Patent
Cai et al.

(10) Patent No.: US 10,443,165 B2
(45) Date of Patent: Oct. 15, 2019

(54) KNITTING METHOD FOR DOUBLE-JACQUARD MESH CLOTH

(71) Applicant: Sincetech (Fujian) Technology Co., Ltd., Quanzhou, Fujian (CN)

(72) Inventors: Qinglai Cai, Fujian (CN); Xiaobing Lu, Fujian (CN)

(73) Assignee: SINCETECH (FUJIAN) TECHNOLOGY CO., LTD., Fujian (CN)

( * ) Notice: Subject to any disclaimer, the term of this patent is extended or adjusted under 35 U.S.C. 154(b) by 176 days.

(21) Appl. No.: 15/697,167

(22) Filed: Sep. 6, 2017

(65) Prior Publication Data

US 2018/0327938 A1 Nov. 15, 2018

(30) Foreign Application Priority Data

May 11, 2017 (CN) ..... 2017 1 0329490

(51) Int. Cl.

| | |
|---|---|
| ***D04B 23/02*** | (2006.01) |
| ***D04B 21/08*** | (2006.01) |
| ***D04B 23/06*** | (2006.01) |

(52) U.S. Cl.

CPC ..... *D04B 23/02* (2013.01); *D04B 21/08* (2013.01); *D04B 23/06* (2013.01)

(58) Field of Classification Search

CPC ..... D04B 21/06; D04B 21/08; D04B 21/10; D04B 21/12; D04B 23/02; D04B 25/10; D04B 25/12; D04B 25/14

See application file for complete search history.

(56) References Cited

U.S. PATENT DOCUMENTS

| | | | | |
|---|---|---|---|---|
| 5,385,036 | A * | 1/1995 | Spillane | A43B 1/04 2/16 |
| 5,899,095 | A * | 5/1999 | Spillane | D04B 21/06 66/195 |
| 6,630,414 | B1 * | 10/2003 | Matsumoto | A47C 31/006 442/1 |
| 6,644,070 | B2 * | 11/2003 | Ikenaga | D04B 21/16 442/318 |
| 7,076,974 | B1 * | 7/2006 | Chen | D04B 21/10 66/195 |
| 7,174,750 | B2 * | 2/2007 | Shirasaki | D04B 21/16 66/195 |
| 7,213,421 | B2 * | 5/2007 | Shirasaki | D04B 21/14 66/193 |
| 2002/0157429 | A1 * | 10/2002 | Matsumoto | D04B 21/02 66/195 |
| 2003/0106346 | A1 * | 6/2003 | Matsumoto | D04B 21/10 66/195 |
| 2011/0247370 | A1 * | 10/2011 | Akao | D04B 21/16 66/195 |
| 2015/0376823 | A1 * | 12/2015 | Daube | D04B 21/14 66/195 |

* cited by examiner

*Primary Examiner* — Danny Worrell
(74) *Attorney, Agent, or Firm* — Harness, Dickey & Pierce, P.L.C.; Anthony G. Fussner

(57) ABSTRACT

A weaving method of double jacquard mesh cloth comprises: first, basic organizations of guide bars are defined, then weaving of double-jacquard mesh cloth of weave; the guide bars laying yarns comprise: ground guide bar GB1 works in the front needle bar in cooperation with the jacquard pattern guide bar JB1, weaves and forms a jacquard pattern effect on the grey cloth front side; the ground guide bar GB6 and the jacquard guide bar JB2 together weaves and forms base cloth of grey cloth, and the jacquard guide bar JB2 weaves and forms a V-point jacquard effect on the grey cloth front side; the ground guide bar GB5 weaves and forms front-back-side connection threads of grey cloth, and by weaving performed by the ground guide bar GB5, the front side and the back side of grey cloth are one-piece-woven and connected into one piece, and double jacquard mesh cloth is woven and formed.

7 Claims, No Drawings

KNITTING METHOD FOR DOUBLE-JACQUARD MESH CLOTH

CROSS-REFERENCE TO RELATED APPLICATION

This application claims the benefit and priority of Chinese Invention Patent Application No. 201710329490.3 filed May 11, 2017. The entire disclosure of the above application is incorporated herein by reference.

TECHNICAL FIELD

The present invention relates to a technical field of mesh cloth production, especially to a weaving method that can effectively weave and connect a grey cloth front side and a grey cloth back side tightly and seamlessly into a one-piece double-jacquard mesh cloth.

BACKGROUND

This section provides background information related to the present disclosure which is not necessarily prior art.

In the existing mesh cloth production technology, double-jacquard mesh cloth is generally woven by adopting a double-needle bar double-jacquard warp knitting machine. Woven double-jacquard mesh cloth generally consists of three layers of a grey cloth front side, an intermediate connection layer and a grey cloth back side. Fabric actually has a three-layer structure. Woven double-jacquard mesh cloth has the following defects:

(1) blistering and wrinkling: in the three-layer structure, in order to be able to form a two-color or multi-color dyeing effect after dyeing fabric, at least two kinds of weaving raw materials have to be used, such as CHINLON nylon silk, DACRON polyester silk, cation material, etc. However, different weaving raw materials have respective different dry-heat shrinkage. Also, each kind of weaving raw material is classified as being inelastic, low elastic, intermediate elastic, high elastic etc., resulting elastic shrinkage ratio is different either. This causes a fact that woven double-jacquard mesh cloth of the three-layer structure is prone to blister and wrinkle;

(2) irregular through-holes: in the three-layer structure, the grey cloth front side and the grey cloth back side are prone to suffer from an offset in a weaving production process. This causes meshes woven on fabric to have a problem of irregular through-holes. Generally, only a through-hole ratio of 50% can be achieved;

(3) exposure of threads inside holes: in the three-layer structure, the grey cloth front side and the grey cloth back side are prone to suffer from the offset in the weaving production process. This causes connection threads of the intermediate connection layer to be exposed in meshes. And this exposure has an irregular disorderly distribution due to different offset ratios occurred between the grey cloth front side and the grey cloth back side. This has a seriously bad effect on the esthetic appearance of woven fabric and reduces a product qualified rate;

(4) a low physical property and a low supporting force: the intermediate connection layer is woven by using a jacquard guide bar JB1 or a jacquard guide bar JB2 on the double-needle bar double-jacquard warp knitting machine. The intermediate connection layer is woven in a horizontal direction. The horizontal wearing plane has a reduced number of connection threads. This causes woven double-jacquard mesh cloth to have a low physical property and a low supporting force. The tearing strength, the tensile breaking strength and the breaking strength of fabric usually do not meet requirements of some international shoemaking brands. Fabric standards are often lowered by negotiating with clients, which reduces the profit of the enterprise badly;

Therefore, it is necessary to develop and improve the weaving method of double-jacquard mesh cloth in order to solve the weaving defects existing in the prior weaving technology, thereby improving the production quality of double-jacquard mesh cloth.

SUMMARY

This section provides a general summary of the disclosure, and is not a comprehensive disclosure of its full scope or all of its features.

With respect to the above-mentioned problems existing in the prior art, the technical problem to be solved by the present invention is to provide a weaving method of double-jacquard mesh cloth. When the weaving method is used to perform weaving, a ground guide bar GB5 weaves and forms front-back-side connection threads of grey cloth, the front side and the back side of grey cloth can be woven and connected tightly and seamlessly into one piece, woven double-jacquard mesh cloth is tightly combined one-layer fabric; the weaving defects of blistering and wrinkling, irregular through-holes, exposure of threads inside holes, the low physical property and the low supporting force of double-jacquard mesh cloth are effectively solved, the production quality of double-jacquard mesh cloth is greatly improved.

The technical solutions of the present invention are as follows: a weaving method of double-jacquard mesh cloth, the double-jacquard mesh cloth being one-piece-woven by a double-needle bar double-jacquard warp knitting machine, the double-needle bar double-jacquard warp knitting machine being provided with a front needle bar, a rear needle bar and guide bars which are used to perform weaving in cooperation with the front needle bar and the rear needle bar; the double-jacquard mesh cloth weaving guide bars being arranged from the front of a worktable to the back of the worktable in order of a ground guide bar GB1, a jacquard guide bar JB1, a jacquard guide bar JB2, a ground guide bar GB5, a ground guide bar GB6, the weaving method of double-jacquard mesh cloth comprising:

first, basic organizations of guide bars are defined as follows:

(1) the basic organization of the ground guide bar GB1 is: 1-0-0-0/0-1-1-1//;

(2) the basic organization of the jacquard guide bar JB1 is: the jacquard guide bar JB1 of one full machine number is divided into a jacquard guide bar JB1.1 and a jacquard guide bar JB1.2 of two half machine numbers;

the basic organization of the jacquard guide bar JB1.1 is: 1-0-1-1/1-2-1-1//;

the basic organization of the jacquard guide bar JB1.2 is: 1-0-1-1/1-2-1-1//;

(3) the basic organization of the jacquard guide bar JB2 is: the jacquard guide bar JB2 of one full machine number is divided into a jacquard guide bar JB2.1 and a jacquard guide bar JB2.2 of two half machine numbers;

the basic organization of the jacquard guide bar JB2.1 is: 1-1-1-0/1-1-1-2//;

the basic organization of the jacquard guide bar JB2.2 is: 1-1-1-0/1-1-1-2//;

the aforementioned jacquard guide bar JB1.1, jacquard guide bar JB1.2, jacquard guide bar JB2.1, jacquard guide bar JB2.2 are arranged from the front of the worktable to the back of the worktable in order, the jacquard guide bar JB1.1 is close to the ground guide bar GB1, the jacquard guide bar JB2.2 is close to the ground guide bar GB5;

(4) the basic organization of the ground guide bar GB5 is: the basic organization of the ground guide bar GB5 is one of the following two basic organizations: 1-1-1-0/1-0-1-0//; or 1-1-2-3/2-1-1-0//;

when the surface of double-jacquard mesh cloth needs to be woven with through-holes, the basic organization of the ground guide bar GB5 is 1-1-1-0/1-0-1-0//;

when the surface of double-jacquard mesh cloth does not need to be woven with through-holes, the basic organization of the ground guide bar GB5 is 1-1-2-3/2-1-1-0//;

(5) the basic organization of the ground guide bar GB6 is: 1-1-2-3/2-2-1-0//;

then, weaving of double-jacquard mesh cloth is performed:

the ground guide bar GB1 lays yarns in the front needle bar; the jacquard guide bar JB1 lays yarns in the front needle bar; the jacquard guide bar JB2 lays yarns in the front needle bar, the rear needle bar; the ground guide bar GB5 lays yarns into coils in the front needle bar, the rear needle bar respectively, the ground guide bar GB6 lays yarns in the rear needle bar;

the weaving raw material used by the ground guide bar GB5 is DACRON silk or CHINLON silk, DACRON silk is preferably 30 D DACRON high elastic silk, CHINLON silk is preferably 40 D CHINLON semigloss silk;

the ground guide bar GB1 works in the front needle bar in cooperation with the jacquard pattern guide bar JB1, weaves and forms a jacquard pattern effect on the grey cloth front side; the ground guide bar GB6 and the jacquard guide bar JB2 together weaves and forms base cloth of grey cloth, and the jacquard guide bar JB2 selectively lays yarns on the grey cloth front side, weaves and forms a V-point jacquard effect on the grey cloth front side; the ground guide bar GB5 weaves and forms front-back-side connection threads of grey cloth, the ground guide bar GB5 completes laying yarns on the grey cloth front side, the coil structure thereof already firmly presses organization coils of the jacquard guide bar JB2 together, and by weaving performed by the ground guide bar GB5, the front side and the back side of grey cloth are one-piece-woven and connected into one piece, and double-jacquard mesh cloth is woven and formed.

Further, weaving raw materials used for double-jacquard mesh cloth are:

the weaving raw material used by the ground guide bar GB1 is: 200 D DACRON low elastic silk;

the weaving raw material used by the jacquard guide bar JB1 is: both the jacquard guide bar JB1.1 and the jacquard guide bar JB1.2 use 200 D DACRON low elastic silk;

the weaving raw material used by the jacquard guide bar JB2 is: both the jacquard guide bar JB2.1 and the jacquard guide bar JB2.2 use 200 D CHINLON semigloss silk;

the weaving raw material used by the ground guide bar GB5 is: 30 D DACRON high elastic silk;

the weaving raw material used by the ground guide bar GB6 is: 200 D CHINLON semigloss silk.

Further, weaving raw materials used for double-jacquard mesh cloth are:

the weaving raw material used by the ground guide bar GB1 is: 200 D CHINLON semigloss silk;

the weaving raw material used by the jacquard guide bar JB1 is: both the jacquard guide bar JB1.1 and the jacquard guide bar JB1.2 use 200 D CHINLON semigloss silk;

the weaving raw material used by the jacquard guide bar JB2 is: both the jacquard guide bar JB2.1 and the jacquard guide bar JB2.2 use 200 D DACRON low elastic silk;

the weaving raw material used by the ground guide bar GB5 is: 40 D CHINLON semigloss silk;

the weaving raw material used by the ground guide bar GB6 is: 200 D DACRON low elastic silk.

The advantageous effects of the present invention:

When the weaving method of the present invention is used to perform weaving, the ground guide bar GB5 weaves and forms front-back-side connection threads of grey cloth, the front side and the back side of grey cloth can be woven and connected tightly and seamlessly into one piece, woven double-jacquard mesh cloth is tightly combined one-layer fabric; so, there are no gaps between the front side and the back side of woven double-jacquard mesh cloth to generate crimples, fabric does not have the problem of blistering and wrinkling; at the same time, the grey cloth front side and the grey cloth back side are aligned in 1:1, the through-hole ratio of meshes on fabric reaches 100%, fabric does not have the problem of irregular through-holes; the grey cloth front side and the grey cloth back side are tightly combined to form the effect of one-layer fabric, no offset occurs, the problem of exposure of threads inside holes of fabric is completely solved, and at the same time, the problem of the low physical property and the low supporting force of fabric is also solved, the tearing strength, the tensile breaking strength and the breaking strength of fabric are effectively improved; furthermore, in the weaving process, according to the function of the ground guide bar GB5, no offsets occur between coils, such that coil structures are arranged evenly, which makes the pattern of double-jacquard mesh cloth more clear and beautiful; thereby the production quality of double-jacquard mesh cloth is greatly improved.

Further areas of applicability will become apparent from the description provided herein. The description and specific examples in this summary are intended for purposes of illustration only and are not intended to limit the scope of the present disclosure.

DETAILED DESCRIPTION

Hereinafter, the present invention is described in further detail in conjunction with embodiments, but the present invention is not limited to the following embodiments.

A weaving method of double-jacquard mesh cloth, the double-jacquard mesh cloth being one-piece-woven by a double-needle bar double-jacquard warp knitting machine, the double-needle bar double-jacquard warp knitting machine being a prior apparatus, the double-needle bar double-jacquard warp knitting machine being provided with a front needle bar, a rear needle bar and guide bars which are used to perform weaving in cooperation with the front needle bar and the rear needle bar; the double-jacquard mesh cloth weaving guide bars being arranged from the front of the worktable to the back of the worktable in order of a ground guide bar GB1, a jacquard guide bar JB1, a jacquard guide bar JB2, a ground guide bar GB5, a ground guide bar GB6, the weaving method of double-jacquard mesh cloth comprising:

first, basic organizations of guide bars are defined as follows:

(1) the basic organization of the ground guide bar GB1 is: 1-0-0-0/0-1-1-1//;

(2) the basic organization of the jacquard guide bar JB1 is: the jacquard guide bar JB1 of one full machine number is divided into a jacquard guide bar JB1.1 and a jacquard guide bar JB1.2 of two half machine numbers;

the basic organization of the jacquard guide bar JB1.1 is: 1-0-1-1/1-2-1-1//;

the basic organization of the jacquard guide bar JB1.2 is: 1-0-1-1/1-2-1-1//;

(3) the basic organization of the jacquard guide bar JB2 is: the jacquard guide bar JB2 of one full machine number is divided into a jacquard guide bar JB2.1 and a jacquard guide bar JB2.2 of two half machine numbers;

the basic organization of the jacquard guide bar JB2.1 is: 1-1-1-0/1-1-1-2//;

the basic organization of the jacquard guide bar JB2.2 is: 1-1-1-0/1-1-1-2//;

the aforementioned jacquard guide bar JB1.1, jacquard guide bar JB1.2, jacquard guide bar JB2.1, jacquard guide bar JB2.2 are arranged from the front of the worktable to the back of the worktable in order, the jacquard guide bar JB1.1 is close to the ground guide bar GB1, the jacquard guide bar JB2.2 is close to the ground guide bar GB5;

(4) the basic organization of the ground guide bar GB5 is: the basic organization of the ground guide bar GB5 is one of the following two basic organizations: 1-1-1-0/1-0-1-0//; or 1-1-2-3/2-1-1-0//;

when the surface of double-jacquard mesh cloth needs to be woven with through-holes, the basic organization of the ground guide bar GB5 is 1-1-1-0/1-0-1-0//;

when the surface of double-jacquard mesh cloth does not need to be woven with through-holes, the basic organization of the ground guide bar GB5 is 1-1-2-3/2-1-1-0//;

(5) the basic organization of the ground guide bar GB6 is: 1-1-2-3/2-2-1-0//;

then, weaving of double-jacquard mesh cloth is performed:

the ground guide bar GB1 lays yarns in the front needle bar; the jacquard guide bar JB1 lays yarns in the front needle bar; the jacquard guide bar JB2 lays yarns in the front needle bar, the rear needle bar; the ground guide bar GB5 lays yarns into coils in the front needle bar, the rear needle bar respectively, the ground guide bar GB6 lays yarns in the rear needle bar;

the weaving raw material used by the ground guide bar GB5 is DACRON silk or chinlon silk, DACRON silk is preferably 30 D DACRON high elastic silk, CHINLON silk is preferably 40 D CHINLON semigloss silk;

the ground guide bar GB1 works in the front needle bar in cooperation with the jacquard pattern guide bar JB1, weaves and forms a jacquard pattern effect on the grey cloth front side; the ground guide bar GB6 and the jacquard guide bar JB2 together weaves and forms base cloth on the grey cloth back side, and the jacquard guide bar JB2 selectively lays yarns on the grey cloth front side, weaves and forms a V-point jacquard effect on the grey cloth front side; the ground guide bar GB5 weaves and forms front-back-side connection threads of grey cloth, the ground guide bar GB5 completes laying yarns on the grey cloth front side, the coil structure thereof already firmly presses organization coils of the jacquard guide bar JB2 together, and by weaving performed by the ground guide bar GB5, the front side and the back side of grey cloth are one-piece-woven and connected into one piece, and double-jacquard mesh cloth is woven and formed;

when the aforementioned weaving method is used to perform weaving, the ground guide bar GB5 only needs a low tensile force to satisfy the weaving production, and weaves and combines the front side and the back side of grey cloth together firmly and effectively; in addition, properly adjusting and increasing the tensile force of the ground guide bar GB5 may be helpful in weaving and combining the front side and the back side of grey cloth together more firmly and effectively. In addition, when the aforementioned weaving method is used to perform weaving, all the feeding yarn position is ¾ in relation to hole of the ground guide bar GB1, the jacquard guide bar JB1, the jacquard guide bar JB2, the ground guide bar GB5, the ground guide bar GB6, and looping position is full, which can greatly reduce the breakage rate of filament of woven products and improve the production quality of weaving.

In a practical weaving production process, when the aforementioned weaving method is used to perform weaving, weaving raw materials used for jacquard mesh cloth are mainly selected in the following two ways:

(1) weaving raw materials used for double-jacquard mesh cloth are:

the weaving raw material used by the ground guide bar GB1 is: 200 D DACRON low elastic silk;

the weaving raw material used by the jacquard guide bar JB1 is: both the jacquard guide bar JB1.1 and the jacquard guide bar JB1.2 use 200 D DACRON low elastic silk;

the weaving raw material used by the jacquard guide bar JB2 is: both the jacquard guide bar JB2.1 and the jacquard guide bar JB2.2 use 200 D CHINLON semigloss silk;

the weaving raw material used by the ground guide bar GB5 is: 30 D DACRON high elastic silk;

the weaving raw material used by the ground guide bar GB6 is: 200 D CHINLON semigloss silk.

After double-jacquard mesh cloth woven by using the above mentioned weaving raw materials goes through a dyeing process, the cloth front side has a light color dyeing effect, the cloth back side has a dark color dyeing effect;

(2) weaving raw materials used for double-jacquard mesh cloth are:

the weaving raw material used by the ground guide bar GB1 is: 200 D CHINLON semigloss silk;

the weaving raw material used by the jacquard guide bar JB1 is: both the jacquard guide bar JB1.1 and the jacquard guide bar JB1.2 use 200 D CHINLON semigloss silk;

the weaving raw material used by the jacquard guide bar JB2 is: both the jacquard guide bar JB2.1 and the jacquard guide bar JB2.2 use 200 D DACRON low elastic silk;

the weaving raw material used by the ground guide bar GB5 is: 40 D CHINLON semigloss silk;

the weaving raw material used by the ground guide bar GB6 is: 200 D DACRON low elastic silk.

After double-jacquard mesh cloth woven by using the above mentioned weaving raw materials goes through a dyeing process, the cloth front side has a dark color dyeing effect, the cloth back side has a light color dyeing effect.

The advantageous effects of the present invention are as follows:

When the weaving method of the present invention is used to perform weaving, the ground guide bar GB5 weaves and forms front-back-side connection threads of grey cloth, the front side and the back side of grey cloth can be woven and connected tightly and seamlessly into one piece, woven double-jacquard mesh cloth is tightly combined one-layer fabric; so, there are no gaps between the front side and the back side of woven double-jacquard mesh cloth to generate crimples, fabric does not have the problem of blistering and wrinkling; at the same time, the grey cloth front side and the grey cloth back side are aligned in 1:1, the through-hole ratio of meshes on fabric reaches 100%, fabric does not have the problem of irregular through-holes; the grey cloth front side and the grey cloth back side are tightly combined to form the effect of one-layer fabric, no offset occurs, the problem of exposure of threads inside holes of fabric is completely solved, and at the same time, the problem of the low physical property and the low supporting force of fabric is also solved, the tearing strength, the tensile breaking strength and the breaking strength of fabric are effectively improved; furthermore, in the weaving process, according to the function of the ground guide bar GB5, no offsets occur between coils, such that coil structures are arranged evenly, which makes the pattern of double-jacquard mesh cloth more clear and beautiful; to sum up, when the weaving method of the present invention is used to perform weaving, the weaving defects existing in the prior weaving technology can be solved effectively, thereby the production quality of double-jacquard mesh cloth is greatly improved. After the weaving method of the present invention is applied to the practical production, woven double-jacquard mesh cloth meets requirements of many international shoemaking brands, and are approved by them.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10.2-8.2-3.3-10, and 3-9.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations in use or operation in addition to the orientation depicted in the figures. For example, if figures are turned over, elements described as "below" or "beneath" other elements or features would then be oriented "above" the other elements or features. Thus, the example term "below" can encompass both an orientation of above and below. An exemplary embodiment may be otherwise oriented (rotated 90 degrees or at other orientations) and the spatially relative descriptors used herein interpreted accordingly.

The above are only preferred embodiments of the present invention, but the protection scope of the present invention is not limited thereto. Any modifications, equivalent substitutions, improvements, etc., made within the spirit and principle of the present invention are to be contained within the protection scope of the present invention.

The invention claimed is:

1. A method of providing double-jacquard mesh cloth, the double-jacquard mesh cloth being one-piece and knitted by a double-needle bar double-jacquard warp knitting machine, the double-needle bar double-jacquard warp knitting machine being provided with a front needle bar, a rear needle bar, and guide bars which are used to perform in cooperation with the front needle bar and the rear needle bar, respective guide bars being arranged from a front of a worktable to a back of the worktable in order of a ground guide bar GB1, a jacquard guide bar JB1, a jacquard guide bar JB2, a ground guide bar GB5, a ground guide bar GB6, wherein the method of providing double-jacquard mesh cloth comprising:

first, basic organizations of guide bars are defined as follows:

(1) the basic organization of the ground guide bar GB1 is: 1-0-0-0/0-1-1-1//;

(2) the basic organization of the jacquard guide bar JB1 is: the jacquard guide bar JB1 is divided into a jacquard guide bar JB1.1 and a jacquard guide bar JB1.2;

the basic organization of the jacquard guide bar JB1.1 is: 1-0-1-1/1-2-1-1//;

the basic organization of the jacquard guide bar JB1.2 is: 1-0-1-1/1-2-1-1//;

(3) the basic organization of the jacquard guide bar JB2 is: the jacquard guide bar JB2 is divided into a jacquard guide bar JB2.1 and a jacquard guide bar JB2.2;

the basic organization of the jacquard guide bar JB2.1 is: 1-1-1-0/1-1-1-2//;

the basic organization of the jacquard guide bar JB2.2 is: 1-1-1-0/1-1-1-2//;

the aforementioned jacquard guide bar JB1.1, jacquard guide bar JB1.2, jacquard guide bar JB2.1, jacquard guide bar JB2.2 are arranged from the front of the worktable to the back of the worktable in order, the jacquard guide bar JB1.1 is close to the ground guide bar GB1, the jacquard guide bar JB2.2 is close to the ground guide bar GB5;

(4) the basic organization of the ground guide bar GB5 is: the basic organization of the ground guide bar GB5 is one of the following two basic organizations: 1-1-1-0/1-0-1-0//; or 1-1-2-3/2-1-1-0//;

when the surface of double-jacquard mesh cloth needs to be provided with through-holes, the basic organization of the ground guide bar GB5 is 1-1-1-0/1-0-1-0//;

when the surface of double-jacquard mesh cloth does not need to be provided with through-holes, the basic organization of the ground guide bar GB5 is 1-1-2-3/2-1-1-0//;

(5) the basic organization of the ground guide bar GB6 is: 1-1-2-3/2-2-1-0//;

then, knitting of double-jacquard mesh cloth is performed:

the ground guide bar GB1 lays yarns in the front needle bar; the jacquard guide bar JB1 lays yarns in the front needle bar; the jacquard guide bar JB2 lays yarns in the front needle bar, the rear needle bar; the ground guide bar GB5 lays yarns into coils in the front needle bar, the rear needle bar respectively, the ground guide bar GB6 lays yarns in the rear needle bar;

the raw material used by the ground guide bar GB5 is polyester silk or nylon silk;

the ground guide bar GB1 works in the front needle bar in cooperation with the jacquard pattern guide bar JB1, forms a jacquard pattern effect on the grey cloth front side; the ground guide bar GB6 and the jacquard guide bar JB2 together forms base cloth of grey cloth, and the jacquard guide bar JB2 selectively lays yarns on the grey cloth front side, forms a V-point jacquard effect on the grey cloth front side; the ground guide bar GB5 forms front-back-side connection threads of grey cloth, the ground guide bar GB5 completes laying yarns on the grey cloth front side, the coil structure thereof already firmly presses organization coils of the jacquard guide bar JB2 together, and by the ground guide bar GB5, the front side and the back side of grey cloth are connected into one piece, and double-jacquard mesh cloth is formed.

2. The method of providing double-jacquard mesh cloth according to claim 1, wherein:

raw materials used for double-jacquard mesh cloth are:

the raw material used by the ground guide bar GB1 is: 200 D polyester low elastic silk;

the raw material used by the jacquard guide bar JB1 is: both the jacquard guide bar JB1.1 and the jacquard guide bar JB1.2 use 200 D polyester low elastic silk;

the raw material used by the jacquard guide bar JB2 is: both the jacquard guide bar JB2.1 and the jacquard guide bar JB2.2 use 200 D nylon semigloss silk;

the raw material used by the ground guide bar GB5 is: 30 D polyester high elastic silk; and the raw material used by the ground guide bar GB6 is: 200 D nylon semigloss silk.

3. The method of providing double-jacquard mesh cloth according to claim 1, wherein:

raw materials used for double-jacquard mesh cloth are:

the raw material used by the ground guide bar GB1 is: 200 D nylon semigloss silk;

the raw material used by the jacquard guide bar JB1 is: both the jacquard guide bar JB1.1 and the jacquard guide bar JB1.2 use 200 D nylon semigloss silk;

the raw material used by the jacquard guide bar JB2 is: both the jacquard guide bar JB2.1 and the jacquard guide bar JB2.2 use 200 D polyester low elastic silk;

the raw material used by the ground guide bar GB5 is: 40 D nylon semigloss silk; and the raw material used by the ground guide bar GB6 is: 200 D polyester low elastic silk.

4. The method of providing double-jacquard mesh cloth according to claim 1, wherein the raw material used by the ground guide bar GB5 is 30 D polyester silk or 40 D nylon silk.

5. The method of providing double-jacquard mesh cloth according to claim 1, wherein the raw material used by the ground guide bar GB5 is 30 D polyester high elastic silk or 40 D nylon semigloss silk.

6. The method of providing double-jacquard mesh cloth according to claim 1, wherein:

raw material used by the ground guide bar GB1 is: 200 D polyester silk;

raw material used by the jacquard guide bar JB1 is: both the jacquard guide bar JB1.1 and the jacquard guide bar JB1.2 use 200 D polyester silk;

raw material used by the jacquard guide bar JB2 is: both the jacquard guide bar JB2.1 and the jacquard guide bar JB2.2 use 200 D nylon silk;

raw material used by the ground guide bar GB5 is: 30 D polyester silk;

raw material used by the ground guide bar GB6 is: 200 D nylon silk.

7. The method of providing double-jacquard mesh cloth according to claim 1, wherein:

raw material used by the ground guide bar GB1 is: 200 D nylon silk;

raw material used by the jacquard guide bar JB1 is: both the jacquard guide bar JB1.1 and the jacquard guide bar JB1.2 use 200 D nylon silk;

raw material used by the jacquard guide bar JB2 is: both the jacquard guide bar JB2.1 and the jacquard guide bar JB2.2 use 200 D polyester silk;

raw material used by the ground guide bar GB5 is: 40 D nylon silk;

raw material used by the ground guide bar GB6 is: 200 D polyester silk.

* * * * *